US009669439B2

(12) United States Patent
Nobile et al.

(10) Patent No.: US 9,669,439 B2
(45) Date of Patent: Jun. 6, 2017

(54) OSCILLATING DESCALER AND METHOD FOR DESCALING A SEMI-FINISHED METALLURGICAL PRODUCT

(75) Inventors: Matteo Nobile, Ruda (IT); Andrea De Luca, Remanzacco (IT); Alfredo Poloni, Fogliano Redipuglia (IT)

(73) Assignee: Danieli & C. Officine Meccaniche S.P.A., Buttrio (IT)

( * ) Notice: Subject to any disclaimer, the term of this patent is extended or adjusted under 35 U.S.C. 154(b) by 212 days.

(21) Appl. No.: 13/983,763

(22) PCT Filed: Mar. 9, 2012

(86) PCT No.: PCT/EP2012/054088
§ 371 (c)(1),
(2), (4) Date: Aug. 5, 2013

(87) PCT Pub. No.: WO2012/120112
PCT Pub. Date: Sep. 13, 2012

(65) Prior Publication Data

US 2013/0340221 A1 Dec. 26, 2013

(30) Foreign Application Priority Data

Mar. 10, 2011 (IT) ..... MI2011A0368

(51) Int. Cl.
*B21B 45/08* (2006.01)
*B24B 55/10* (2006.01)
(Continued)

(52) U.S. Cl.
CPC ..... *B21B 45/08* (2013.01); *B24B 55/102* (2013.01); *B24D 9/08* (2013.01); *B21B 45/06* (2013.01); *Y10T 29/4544* (2015.01)

(58) Field of Classification Search
CPC ..... B21B 45/04; B21B 45/45; B21B 45/06; B21B 45/08; Y10T 29/4517; Y10T 29/4533; Y10T 29/4544
See application file for complete search history.

(56) References Cited

U.S. PATENT DOCUMENTS 5,460,023 A * 10/1995 Ginzburg ..... B21B 45/08 72/236
6,389,666 B1 * 5/2002 Grothe ..... B21B 45/08 29/81.03
2009/0217945 A1 * 9/2009 Runkel ..... B22D 11/12 134/9

FOREIGN PATENT DOCUMENTS

DE 19935780 2/2001
EP 1018377 7/2000
(Continued)

*Primary Examiner* — Teresa M Ekiert
(74) *Attorney, Agent, or Firm* — Stetina Brunda Garred & Brucker

(57) ABSTRACT

An oscillating descaler (1) for semi-finished metallurgical products comprises:—a passageway (2) delimited by two opposite input and output sections (3, 4) crossable by a semi-finished product (10) to be descaled according to a rectilinear crossing direction (X) oriented from the input section (3) to the output section (4),—a manifold (20) for a pressurized fluid extended according to a longitudinal direction (Y) defined between first and second longitudinally opposite ends (21, 22), arranged so that the longitudinal direction (Y) is not parallel to the crossing direction (X),—at least one nozzle (30) for spraying a jet (31) according to a spray direction (Z) which is coaxial to a hole (30*a*) of the nozzle (30) and inclined towards the input section (3) and towards one of the ends (21, 22) of the manifold (20, 20*b*),—motor means (M) for generating a rectilinear oscillating motion of the jet (31) along the longitudinal direction (Y).

9 Claims, 4 Drawing Sheets

(51) Int. Cl.
*B24D 9/08* (2006.01)
*B21B 45/06* (2006.01)

(56) References Cited

FOREIGN PATENT DOCUMENTS

| | | |
|---|---|---|
| EP | 1707283 | 10/2006 |
| JP | 09085329 | 3/1997 |

* cited by examiner

OSCILLATING DESCALER AND METHOD FOR DESCALING A SEMI-FINISHED METALLURGICAL PRODUCT

FIELD OF THE INVENTION

The present invention relates to an oscillating descaler for semi-finished metallurgical products and to a method for descaling a semi-finished metallurgical product.

STATE OF THE ART

Within the technical scope of manufacturing semi-finished steel products, downstream of the continuous casting and/or upstream of the rolling, the use of high-pressure water jet descaling devices is known for removing the oxide layer on the surfaces of the semi-finished product following the exposure to the ambient air at high temperatures.

In the state of the art are known slabs descaling devices, which typically comprise a manifold elongated in shape according to a longitudinal axis, in which pressurized fluid—generally water—is circulated, the manifold comprising a plurality of nozzles, regularly spaced along the longitudinal axis of the manifold, through which the pressurized water is sprayed onto one or more surfaces to be descaled.

The manifold is arranged in the descaler in a position spaced apart from a sliding plane of the slabs and oriented so that the longitudinal axis thereof is almost orthogonal or anyhow transversal to a slab feeding direction along the sliding plane. Such an arrangement ensures that the jets generated by the nozzles strike the slab over its whole width, defined as the dimension orthogonal to the feeding direction. The feeding along the sliding plane allows the slab to be taken at the jets over its whole length, defined as the dimension parallel to the feeding direction.

In order to maximize the impact strength of the jet on the slab, the nozzles are expected to be arranged so as to minimize the jet length, i.e. with the median direction of the jet directed orthogonally to the surface to be descaled or in any event very close to the right angle.

In order to increase the descaler efficiency, the provision of handling means connected to the manifold is also known, in order to apply a rectilinear oscillating motion thereto along its longitudinal axis.

The advantages of these solutions, e.g. known from patent publications EP 0526440 and KR 2004/0054975, are determined by the oscillating motion of the manifold allowing an effective coverage of the surface to be descaled while decreasing the number and/or dimensions of jets. This firstly results in a decrease of the pressure and of the water flow rate employed in descaling operations with apparent cost benefits. Furthermore, as a consequence of decreasing the water flow rate which strikes the surface to be descaled, less cooling of the slab is obtained, which is an advantageous feature for a descaler since an excessive cooling of the slab is energy consuming and may often compromise the correct execution of other machining operations downstream of the descaler, in particular plastic deformation operations such as rolling.

The above-described solutions are not yet optimal solutions, as they may be improved under many aspects and in particular with regards to the water flow rate employed for the jets.

In order to obtain such an improvement, it is possible to proceed as indicated in document EP 1707283, by applying a second oscillating motion to the manifold, of the rotary type about the longitudinal axis thereof. By coordinately controlling the two rectilinear and rotary oscillating motions, the jets may intercept the surface to be descaled according to traces of the desired shape, even regardless of the slab feeding speed. For example, with simple cylindrical jets, static traces may be generated, i.e. obtained with null slab feeding speed, which are circular in shape with a diameter much greater than that of the individual jets.

The main drawback of such a solution is determined by the complexity of the motion components required to transmit the oscillating motion about the longitudinal axis of the manifold, which also require increased maintenance.

Moreover, the components selected to supply pressurized water are also more complex due to the type of motion given to the manifold.

Another solution is shown in document EP 1018377, where to ensure an effective descaling action of the jets, it is provided that they act on respective deflection areas of the semi-finished product.

The main drawback of such a solution lies in that the deflection is obtained by means of rollers which make the descaler globally complex in terms of construction, and cumbersome. Moreover, since a deflection roller is provided at each collector on the opposite side with respect to the semi-finished product, the manifolds may not be arranged in a symmetrical position with respect to the semi-finished product feeding direction. Accordingly, the two manifolds provided for the two sides of the semi-finished product, respectively, are to be spaced along the semi-finished product feeding direction, thus determining an increase of the space occupied by the descaler along such a direction.

SUMMARY

The object of the present invention is to provide a new oscillating descaler for semi-finished metallurgical products which is particularly efficient with regards to the consumption of pressurized water, effective in terms of removing the oxide layer and of the degree of covering the surface to be descaled, reliable with regards to the amount of maintenance required, compact and easy to be constructed, thus allowing the advantages of the solutions described with reference to the known art mentioned to be optimized, while eliminating the drawbacks.

Another object is to provide a method for descaling a semi-finished metallurgical product which can be implemented by means of the above-mentioned oscillating descaler.

In accordance with the invention, the aforesaid technical problem is solved by means of an oscillating descaler with the features stated in independent claim 1 and by means of a method with the features stated in independent claim 13.

In particular, in a first aspect, the invention relates to an oscillating descaler comprising:

- a passageway delimited by an input section and an opposite output section, said passageway being crossable by at least one semi-finished metallurgical product to be descaled according to a crossing rectilinear direction oriented from said input section to said output section,
- at least one manifold for a pressurized fluid, extended along a longitudinal direction defined between a first longitudinal end and a second opposite longitudinal end of said manifold, said manifold being arranged so that said longitudinal direction is not parallel to said crossing direction, said manifold being provided with at least one nozzle for spraying a jet of said fluid according to a spray direction which is coaxial to an outlet hole of said nozzle, said spray direction being oriented from said manifold towards said passageway so as to intercept said semi-finished product to be descaled, motor means for generating a rectilinear oscillating motion of said jet along said longitudinal direction, characterized in that said nozzle is oriented so that said spray direction is inclined towards said input section and inclined towards one or the other of said first and second longitudinal ends of said manifold.

Therefore, with the present invention, a descaler may be obtained, which is capable of generating jets inclined countercurrent with respect to the direction according to which the semi-finished product crosses the descaler and at the same time inclined towards the side edges of the semi-finished product, parallel to the crossing direction.

Advantageously, with the first inclination of the jet called "countercurrent", an increase of the action of removing the oxide layer to be removed is obtained, with respect to solutions with jet orthogonal to the surface to be descaled. Further advantageously, the second inclination of the jet, called "lateral", determines a sweeping action on the surface to be descaled towards the edges thereof, thus allowing both the oxide scales and the water of the jets to be constantly removed. The elimination of stagnating water on the descaled surface contributes to decreasing the removal of heat thus decreasing the cooling of the semi-finished product, the removal of the removed scales prevents their accumulation on the semi-finished product, thus keeping the surface which has still not been descaled free, and thus allowing the jets to strike the oxide layer not yet removed, thus maximizing the efficiency of the descaler.

The above-described advantages have the obvious consequence of decreasing the water flow rate consumed by the descaler of the present invention.

Using motor means adapted to generate a purely rectilinear oscillating motion of the manifold allows the descaler to be simpler, while minimizing or nullifying the maintenance required, unlike the solutions suggested for example in EP 1707283 which include generating oscillating motions with a rotary component.

In a second aspect thereof, the invention relates to a method for descaling a semi-finished steel product comprising the steps of:

defining a passageway delimited by an input section and an opposite output section, said passageway being crossable by at least one semi-finished metallurgical product to be descaled according to a crossing rectilinear direction oriented from said input section to said output section, generating at least one jet of a pressurized fluid oriented towards a surface to be descaled of said semi-finished product, applying a rectilinear oscillating motion to said at least one jet along a longitudinal direction arranged so as not to be parallel to said crossing direction, characterized in that said jet is oriented so as to be inclined towards said input section of said passageway and inclined towards an edge of said surface to be descaled, which is arranged parallel to said crossing direction.

Similarly to the above disclosure with reference to the first aspect, the present invention allows a method for descaling a semi-finished product to be obtained, which is capable of achieving the same above-described advantages with reference to the above-described new descaler. Moreover, according to the method of the present invention, the same advantages may be obtained regardless of the system selected for generating the jets of pressurized fluid, as long as these are oriented so as to be inclined according to the "countercurrent" and "lateral" inclinations defined above.

Other advantages of the present invention are achieved by means of an oscillating descaler in accordance with the dependent claims, as better set forth in the following description. In particular, the laminar jet with rectilinear trace parallel to the crossing direction allows an optimal coverage to be obtained of the surface to be descaled.

BRIEF DESCRIPTION OF THE DRAWINGS

Further features and advantages of the present invention will become more apparent from the following detailed description of a preferred, but not exclusive, embodiment thereof, shown by way of non-limiting example with reference to the accompanying drawings, in which.

DETAILED DESCRIPTION OF THE INVENTION

Figure 1:
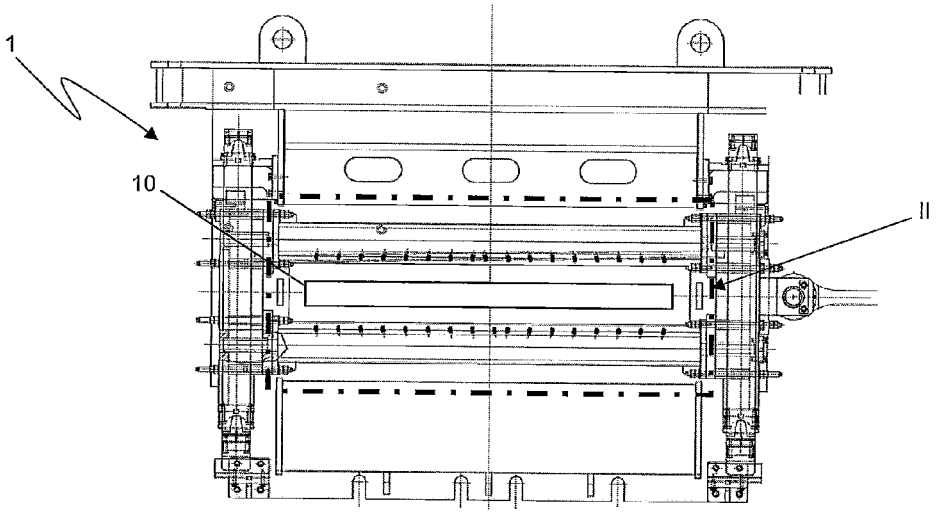
FIG. 1 is a front view of an oscillating descaler for semi-finished metallurgical products, according to the present invention.

With reference to the accompanying figures, an oscillating descaler for semi-finished metallurgical products is indicated as a whole with numeral 1.

In particular, although not exclusively, descaler 1 is employable for semi-finished metallurgical products where the surfaces to be descaled are flat surfaces, for example for slabs. However, the present invention is not generally characterized by a particular type of semi-finished metallurgical product to be treated, rather other semi-finished metallurgical products, for example having as circular section, may also be treated with a descaler constructed in accordance with the present invention.

Descaler 1 is susceptible to being inserted into a line for producing semi-finished metallurgical products, downstream of the line sections where the semi-finished metallurgical products are produced, for example by means of continuous casting. Typically, although not exclusively, a section of further machining by means of plastic deformation of the descaled semi-finished product, for example by means of rolling, is provided downstream of descaler 1.

Descaler 1 comprises a substantially parallelepiped passageway 2, delimited by two opposite faces, forming an input section 3 and an opposite output section 4, respectively, for a semi-finished product 10 to be descaled.

In the embodiment in the figures, the semi-finished product 10 is a slab provided with two opposite base surfaces 11 and 11*b* to be descaled, and with four side surfaces 13*a,b,c,d*, which are orthogonal to the base surfaces 11 and 11*b*.

Passageway 2 is crossable by slab 10 along a crossing plane XW, parallel to the base surfaces 11 and 11*b* and equidistant therefrom, according to a crossing direction X oriented from the input section 3 to the output section 4.

Slab 10 is oriented so as to cross passageway 2 with two opposite side surfaces 13*a,b* parallel to the crossing direction X, and with two opposite side surfaces 13*c,d* orthogonal to the crossing direction X. Side surfaces 13*c,d* are referred to as rear and front surfaces, respectively, as they face upstream and downstream with respect to the crossing direction X, respectively. The intersections between base surfaces 11 and 11*b* and side surfaces 13*a,b* parallel to the crossing direction X define, on each of the base surfaces 11 and 11*b*, two respective edge corners 12*a,b* and 12*c,d*, which are also oriented parallel to the crossing direction X.

Descaler 1 comprises two manifolds 20, 20*b* for a pressurized fluid which are in respective positions arranged symmetrically with respect to the crossing plane XW. Advantageously, for the purposes of the invention, pressurized water is circulated in the manifolds 20, 20*b*.

Figure 2:
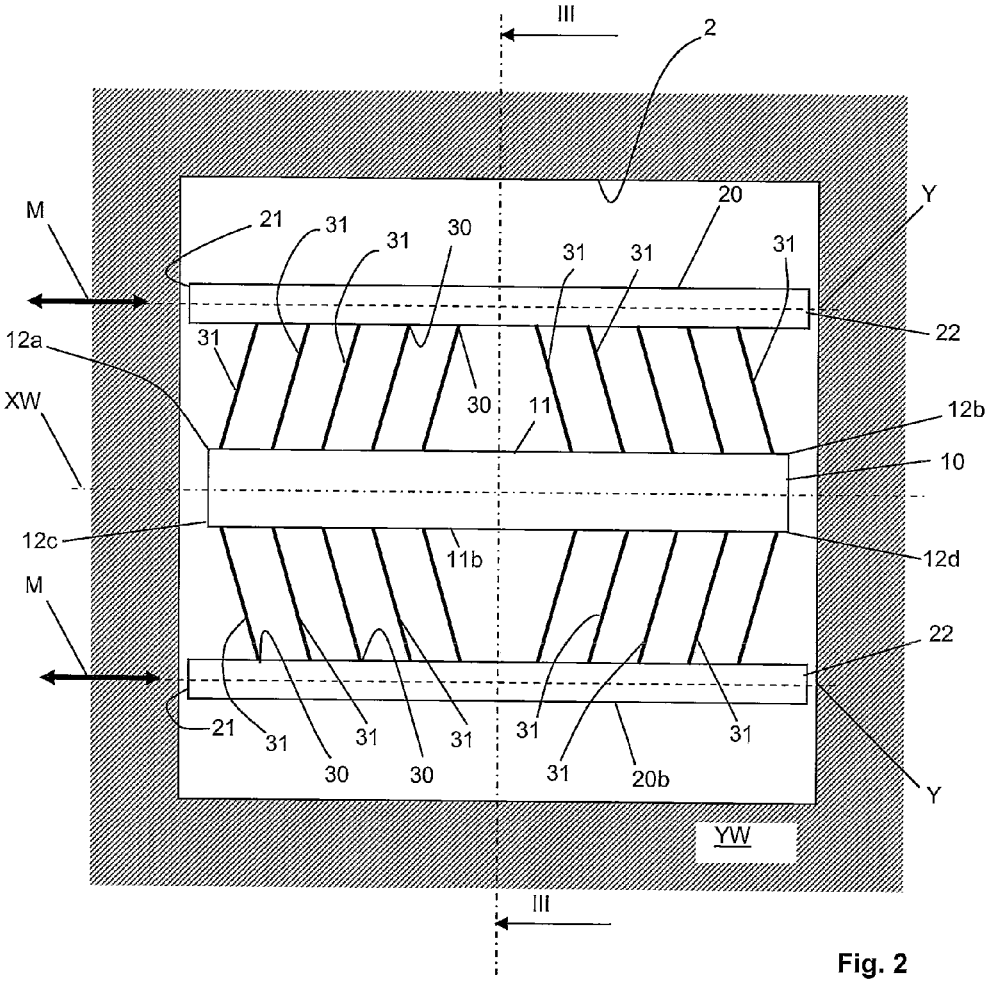
FIG. 2 is a diagrammatic view of detail II of the descaler in FIG. 1.
Figure 3:
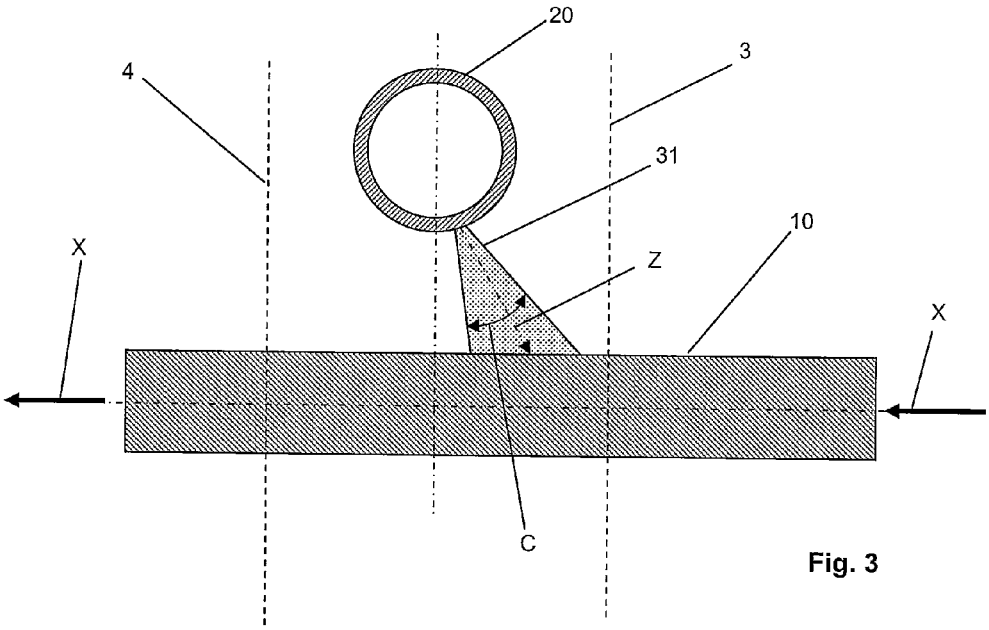
FIG. 3 is a diagrammatic cross-section view of the detail in FIG. 2, taken according to the section line III-III.

Each of the manifolds 20, 20*b* is cylindrical in shape, axially extends according to a longitudinal direction Y defined between a first longitudinal end 21 and a second opposite longitudinal end 22 of manifold 20, 20*b*. The axes of manifolds 20, 20*b* are parallel to each other and define a plane YW (plane in FIG. 2) containing the longitudinal direction Y orthogonal to the crossing plane XW.

With respect to a semi-finished product 10 laying on plane XW within passageway 2, the manifolds 20, 20*b* are arranged on opposite ides so as to face the surfaces 11, 11*b*, respectively. With respect to passageway 2, each manifold 20, 20*b* is arranged and oriented so that the longitudinal direction Y is not parallel to the crossing direction X.

Figure 4:
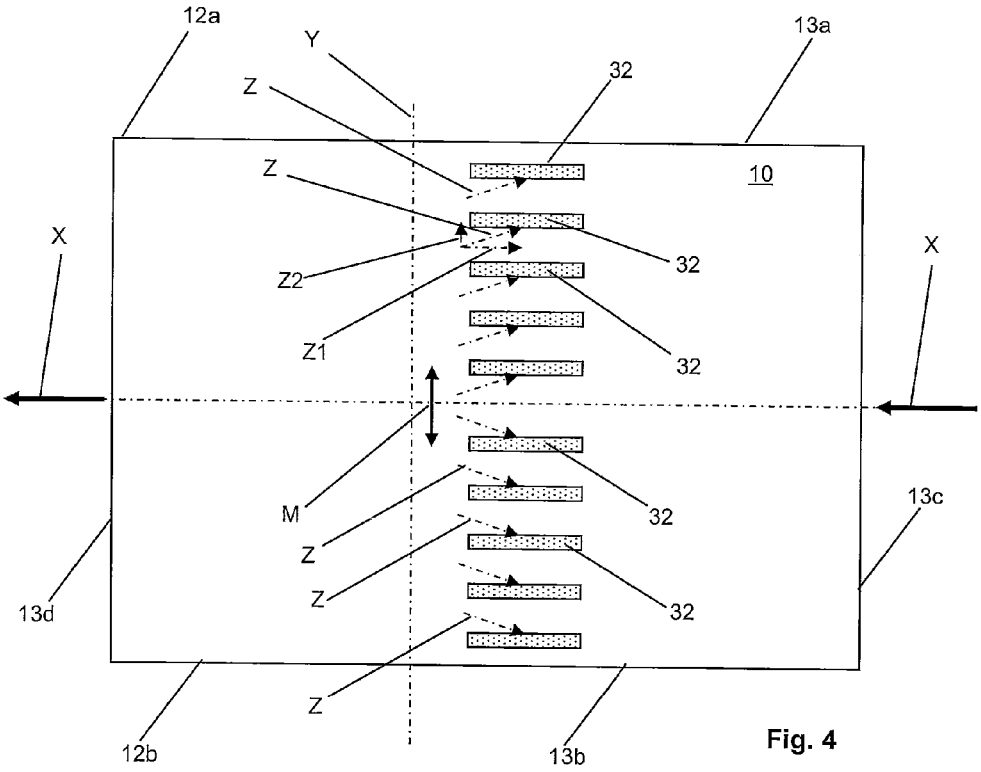
FIG. 4 is a diagrammatic top view of the detail in FIGS. 2 and 3.
Figure 5:
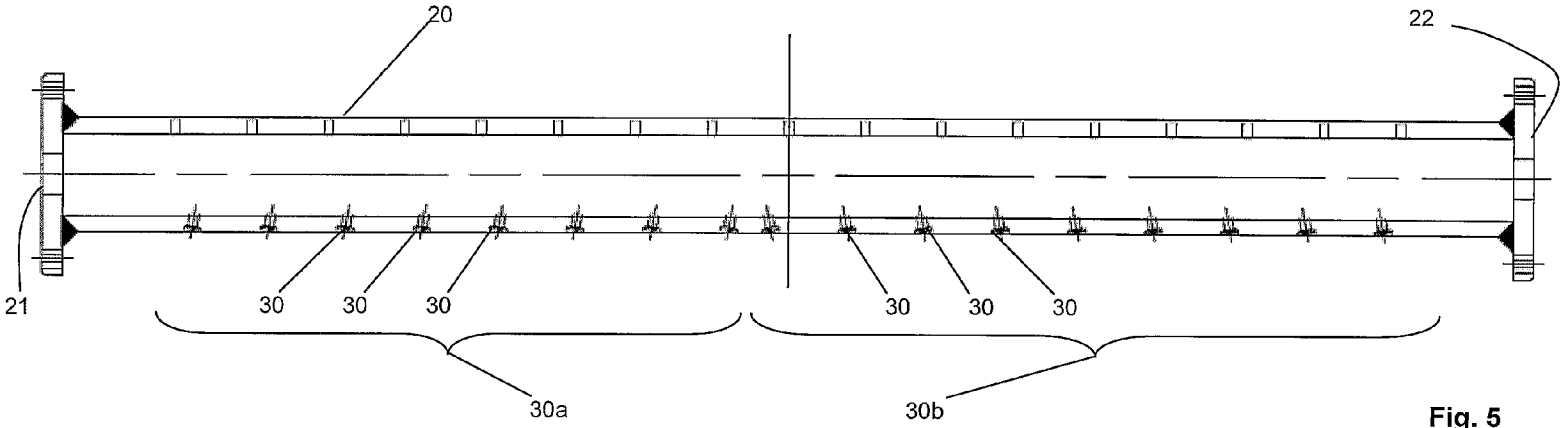
FIG. 5 is a front view of a component of the descaler in FIG. 1.
Figure 6:
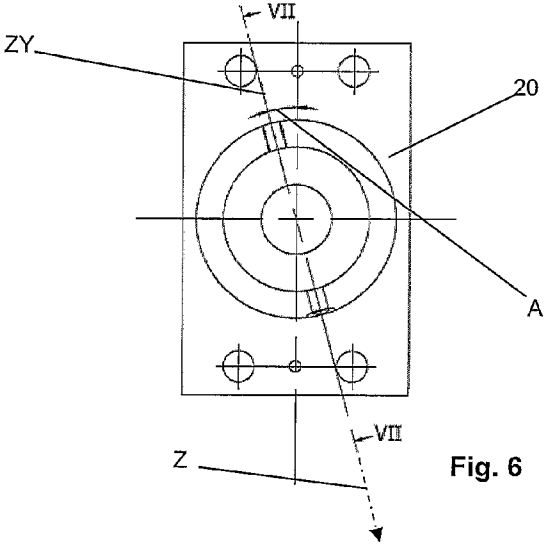
FIG. 6 is a side view of the component in FIG. 5.
Figure 8:
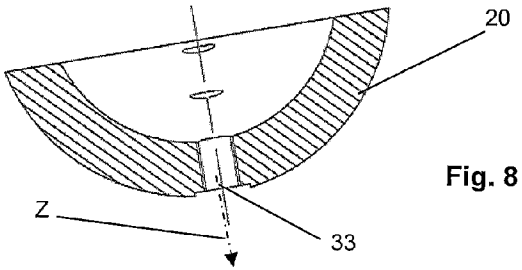
FIG. 8 is a section view of the component in FIG. 5, taken according to the section line VIII-VIII in FIG. 7.

For the scopes of the present invention, in a top view (FIG. 4) the longitudinal direction Y is advantageously arranged orthogonal to the crossing direction X, so as to be parallel to the side surfaces 13*c, d* and orthogonal to the side surfaces 13*a, b* and to the edge corners 12*a, b* and 12*c, d* of the base surfaces 11, 11*b*.

Each manifold 20, 20*b* is provided with a plurality of respective nozzles 30, distributed regularly along the respective manifold 20, 20*b*, the first longitudinal end 21 and the second longitudinal end 22.

The nozzles 30 are of known and conventional type and for this reason are not described in detail. Each of the nozzles 30 of each of the manifolds 20, 20*b* comprises a respective outlet hole 33 and is adapted to spray a respective jet 31 of the pressurized fluid circulating in the respective manifold 20, 20*b* according to a respective spray direction Z which is coaxial to the respective outlet hole 33 and oriented from the respective manifold 20, 20*b* towards passageway 2 and the crossing plane XW, so as to intercept the respective base surface 11, 11*b* of slab 10 to be descaled.

For each spray jet 31, the spray direction Z is defined as a trajectory distribution average of the particles of fluid forming the respective jet 31. For example, in the case of cylindrical or conical jets, the spray direction is aligned with the axis of the cylinder or cone, respectively, described by the particles of the jet.

Advantageously, as better disclosed below, according to the embodiment depicted in the accompanying figures, the jets 31 have a laminar shape, widening from the respective manifold 20, 20*b* towards the slab 10 to be descaled, according to an opening angle C. The spray direction Z for such a type of jet is identified as the direction aligned with the bisector of the opening angle C.

The orientation of the spray directions Z output from the respective manifold 20, 20*b* is determined by the type, by the orientation of the nozzles 30, by the shape thereof, as they are susceptible to being coaxially arranged at a respective outlet hole 33 of the respective nozzle 30.

Figure 7:
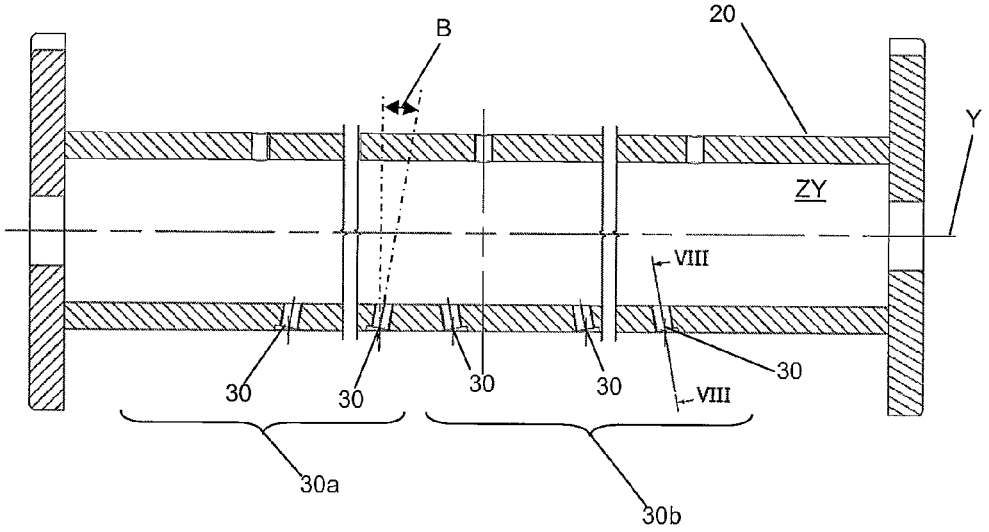
FIG. 7 is a section view of the component in FIG. 5, taken according to the section line VII-VII.

For each manifold 20, 20*b*, the spray directions Z of the jets 31 output from manifold 20, 20*b* are all contained along a same longitudinal plane ZY (plane in FIG. 7) encompassing the longitudinal direction Y. Each manifold 20, 20*b* is connected to descaler 1 so that, with respect to plane YW, plane ZY is inclined according to a first spray angle A. Due to such a first inclination, so-called "countercurrent", the outlet holes 33 and the spray directions Z are inclined towards the input section 3.

Preferably, the value of the first spray angle A is between 5° and 20°, with respect to a plane which is orthogonal to said crossing direction.

More preferably, the value of the first spray angle A is between 14° and 16°. Even more preferably, the value of the first spray angle is equal to 15°.

Due to the inclination determined of the first spray angle A, the spray direction Z has a first component Z1 which is parallel and opposite to the crossing direction X. Thereby, the relative speed of all particles forming spray 31 with respect to the portion of base surface 11, 11*b* which is struck by such a particle is not only determined by the thrust of the jet, but also by the speed of slab 10 along the crossing direction X. If certain portions of oxide scales are already partly detached and raised with respect to the surfaces 11, 11*b*, the countercurrent inclination allows the jets 31 to wedge in more easily between the surface 11, 11*b* and the oxide scale with respect to solutions with jets orthogonal to the surfaces to be descaled. Therefore, the inclination of the spray direction Z according to the first spray angle A determines increased efficiency of the descaling action of the jets 31.

For each of the manifolds 20, 20*b*, the plurality of nozzles 30 is further inclined according to a second spray angle B so as to be divided into a first portion of nozzles 30*a* which respective outlet holes 33 are inclined towards the first longitudinal end 21, and a second portion of nozzles 30*b* which respective outlet holes 33 are inclined towards the second longitudinal end 22.

The portions of nozzles 30*a* and 30*b* covering an equal number of nozzles 30, which are distributed so as to divide each of the manifolds 20, 20*b* in two adjacent halves, longitudinally extend along direction Y. Each half of each manifold 20, 20*b* comprises a respective longitudinal end 21, 22 and the portion of nozzles 30*a*, 30*b* inclined towards such a respective longitudinal end 21, 22, respectively.

The orientation of the nozzles 30 and in particular of the respective outlet holes 33 according to the second spray angle B implies that the spray directions Z are inclined towards the first longitudinal end 21 for the first portion of nozzles 30*a*, and towards the second longitudinal end 22 for the second portion of nozzles 30*b*.

Due to such a second inclination, so-called "lateral", determined by the second spray angle B, the spray angle Z has a second component Z2, which is orthogonal to the crossing direction X and facing one of the edge corners 12*a,b,c,d*, in particular the edge corner 13*a,b,c,d*, closest to the longitudinal end 21, 22 towards which the respective spray direction is inclined.

The second spray angle B is geometrically definable as the angle between the spray direction Z and a plane orthogonal to the longitudinal direction Y. The second spray angle B in plane ZY containing the spray directions Z (plane in FIG. 7) is depicted as angle between the spray direction Z and a direction orthogonal to the longitudinal direction Y.

Preferably, the second spray angle B is between 5° and 20°. More preferably, the second spray angle B is between 8° and 12°. Even more preferably, the second spray angle B is equal to 15°.

Descaler 1 is provided with motor means (diagrammatically depicted by the bidirectional arrow M in the accompanying figures) for generating a rectilinear oscillating motion of jet 31 along the longitudinal direction Y. The motor means M are connected to the manifolds 20, 20*b* to transmit such a rectilinear oscillating motion thereto and therefore to the nozzles 30.

For the purposes of the present invention, any mechanical device capable of transmitting an oscillating motion along a rectilinear direction may be conveniently employed, for example a linear motor or a rotary engine connected to a rod-crank mechanism or a rotary engine with an eccentric mass or others.

The "lateral" inclination of the jets 31 and the oscillating activation of the jets by means of the motor means M allow the oxide scales removed and the water of the jets to be pushed towards the edges 12*a,b,c,d*, also when the surface to be descaled is horizontal and faces upwards. This determines a decreased removal of heat with respect to known descalers and an increased efficiency of the descaling action of the jets due to the oxide scales removed and eliminated past the edges 12*a,b,c,d* cannot interfere with the action of the jets 31.

The presence of the motor means M allows impression 35 swept by each jet 31 on the base surface 11, 11*b*, to be increased. To further increase impression 35, jet 31 has a laminar shape and oriented so as to intercept the semi-finished product 10 according to a respective static rectilinear trace 32 and substantially parallel to the crossing direction X. Static trace of jet 31 means a trace obtained with the motor means M stationary and with null feeding speed of slab 10 along direction X. To obtain such a shape of static trace, the laminar jet 31 has a shape widening from the respective manifold 20, 20*b* towards the base surface 11, 11*b* to be descaled of the semi-finished product 10, according to an opening angle C of jet 31, between 10° and 20°. According to an embodiment of the present invention, the opening angle C of jet 31 is equal to 15°.

The type of jet 31 selected allows the extension of impression 35 swept from trace 32 to be controlled by controlling the amplitude and the frequency of the oscillating motion transmitted by the motor means M. With the present invention, it is possible to obtain a degree of coverage of the surface to be descaled—defined as ratio between the overall extension of all the impressions 35 and the extension of the surface to be descaled—equal to 100%.

Figure 9:
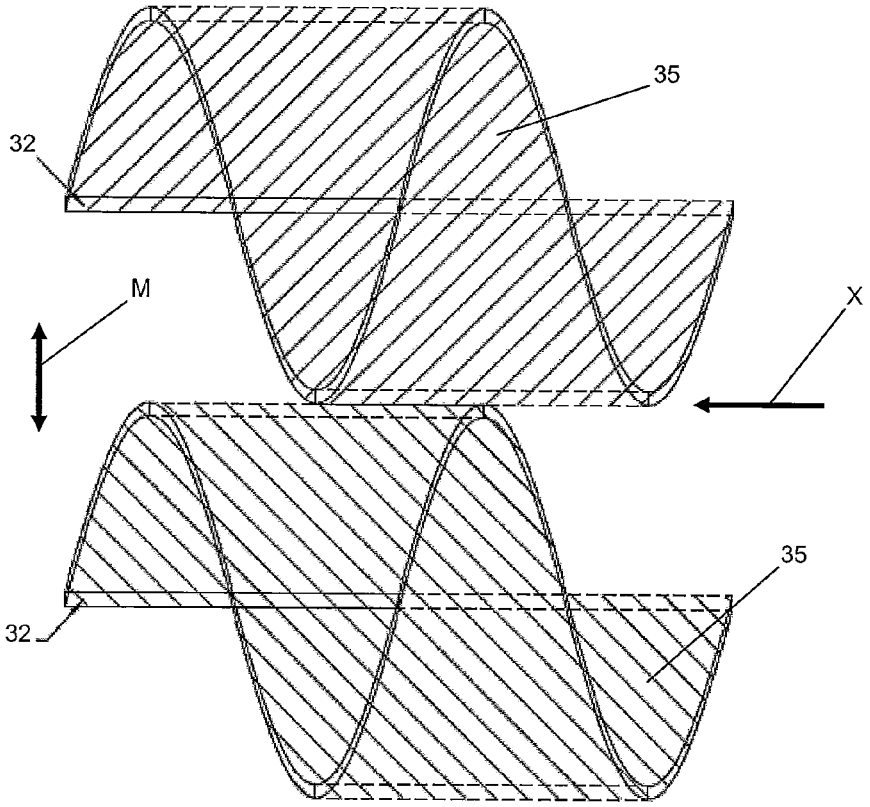
FIG. 9 is a diagram depicting the trace of a scaling jet generated with the descaler in FIG. 5.

In particular, by selecting the amplitude of the oscillating motion so that it is equal to or greater than half the distance between two adjacent nozzles 30 (FIG. 9), it is possible to cover the base surface 11, 11*b* over its whole width, defined as the dimension extending between the side surfaces 13*a,b*. Moreover, by conveniently selecting the oscillating frequency according to the length of the static trace 32 and to the feeding speed of slab 10 along the crossing axis X, it is possible to obtain complete coverage of the base surface 11, 11*b* also in the longitudinal direction, defined as the dimension extending between the rear and front side surfaces 13*c,d*.

With reference to the same elements described above and depicted in the accompanying figures, below is the description of a method for descaling a semi-finished metallurgical product 10. Such a method comprises a first step 110 by means of which a passageway 2 is defined, delimited by an input section 3 and an opposite output section 4. Passageway 2 is crossable by a semi-finished metallurgical product, for example a slab 10 to be descaled according to a crossing direction X oriented from the input section 3 to the output section 4.

In a successive second step of the method, a plurality of spray jets 31 of pressurized fluid is generated towards a base surface 11, 11*b* to be descaled of slab 10. Each jet 31 is oriented so as to be simultaneously inclined towards the input section 3, according to a first spray angle A and inclined towards a respective edge corner 12*a, b, c, d*, of the base surface 11, 11*b* to be descaled. In order to define the orientation of each jet 31, reference is made to the orientation of the respective spray direction Z, defined as the trajectory distribution average of the fluid particles forming the respective jet 31.

A system equal or similar to the above-described descaler 1 may be employed to generate a plurality of jets 31, comprising the manifolds 20, 20*b* and the nozzles 30. However, for the purposes of the present invention, other systems for generating the jets 31 may be advantageously employed as long as they are characterized by double inclination, according to the first and the second angles A, B.

Laminar jets 31 may be advantageously employed with a development widened from the jet source towards the semi-finished product 10, according to an opening angle C.

In a further third step of the method, a rectilinear oscillating motion is applied to each jet 31 along a longitudinal direction Y arranged so as to be orthogonal to the crossing direction X.

The technical solutions described allow the established task and objects to be completely achieved with reference to the known art mentioned, thus achieving a plurality of further advantages, including an increased degree of coverage of the surfaces to be descaled, even equal to 100%, without being obliged to transmit oscillating motions with a rotary component to the jets 31. The effectiveness of the jets of the descaler of the present invention allows the established objects to be achieved without bending the semi-finished product at the manifolds. Therefore, the semi-finished product may be kept in a flat configuration, thus allowing a pair of manifolds 20, 20*b* to be arranged in respective symmetrical positions with respect to the crossing plane XW. This advantageously allows the dimensions to be contained along the crossing direction X, thus making descaler 1 particularly compact, in addition to constructionally easier as compared to known solutions and allows to descale any slab thickness.

The invention claimed is:

1. An oscillating descaler for semi-finished metallurgical products comprising a passageway delimited by an input section and an opposite output section, said passageway being crossable by at least one semi-finished metallurgical product to be descaled according to a crossing direction oriented from said input section to said output section, said descaler comprising at least one manifold for a pressurized fluid, said at least one manifold being extended according to a longitudinal direction defined between a first longitudinal end and a second opposite longitudinal end of said at least one manifold, said at least one manifold being arranged so that said longitudinal direction is not parallel to said crossing direction, said at least one manifold being provided with a plurality of nozzles, each nozzle of said plurality of nozzles being for spraying said fluid according to a spray direction which is coaxial to an outlet hole of said nozzle, the spray direction of each nozzle of said plurality of nozzles being oriented from said at least one manifold towards said passageway so as to intercept said semi-finished metallurgical product to be descaled, said descaler being provided with motor means for generating a rectilinear oscillating motion of said plurality of nozzles along said longitudinal direction, each nozzle of said plurality of nozzles being oriented so that the spray direction of said nozzle is inclined towards said input section and inclined towards one or the other of said first and second longitudinal ends of said at least one manifold, wherein each nozzle of said plurality of nozzles is adapted to generate a jet having a laminar shape and oriented so as to intercept said semi-finished product to be descaled according to a rectilinear static trace substantially parallel to said crossing direction, and wherein said plurality of nozzles has a first portion of nozzles whose spray directions are inclined towards said first longitudinal end of said at least one manifold and a second portion of nozzles whose spray directions are inclined towards said second longitudinal end of said at least one manifold.

2. An oscillating descaler according to claim 1, wherein the jet generated by each nozzle of said plurality of nozzles has a widened shape from said at least one manifold towards said semi-finished metallurgical product to be descaled.

3. An oscillating descaler according to claim 2, wherein the jet generated by each nozzle of said plurality of nozzles widens from said at least one manifold towards said semi-finished metallurgical product to be descaled according to an opening angle of the jet between 10° and 20°.

4. An oscillating descaler according to claim 1, wherein the spray direction of each nozzle of said plurality of nozzles is inclined towards said input section according to a first spray angle between 5° and 20° with respect to a plane which is orthogonal to said crossing direction.

5. An oscillating descaler according to claim 4, wherein, for each nozzle of said plurality of nozzles, said first spray angle is between 14° and 16°.

6. An oscillating descaler according to claim 1, wherein, for each nozzle of said plurality of nozzles, said spray direction is inclined towards either of said first and second longitudinal ends according to a second spray angle between 5° and 20° with respect to a plane which is orthogonal to said longitudinal direction.

7. An oscillating descaler according to claim 6, wherein, for each nozzle of said plurality of nozzles, said second spray angle is between 8° and 12°.

8. An oscillating descaler according to claim 1, wherein the plurality of nozzles is evenly distributed along said at least one manifold between said first and second longitudinal ends.

9. An oscillating descaler according to claim 1, wherein said descaler comprises two manifolds which are parallel to each other and symmetrically arranged with respect to the crossing direction of said passageway.

* * * * *